US006262011B1

(12) United States Patent
Boeckh et al.

(10) Patent No.: US 6,262,011 B1
(45) Date of Patent: Jul. 17, 2001

(54) POLYCATIONIC CONDENSATES AS COLOR TRANSFER INHIBITING AND COLOR RELEASE REDUCING ADDITIVE TO DETERGENTS AND FABRIC CONDITIONERS

(75) Inventors: Dieter Boeckh, Limburgerhof; Hans-Ulrich Jäger, Neustadt; Jürgen Alfred Lux, Niederkirchen, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/467,239

(22) Filed: Dec. 20, 1999

Related U.S. Application Data

(62) Division of application No. 09/284,479, filed on Apr. 21, 1999, now Pat. No. 6,025,322, which is a continuation of application No. PCT/EP97/05606, filed on Oct. 10, 1997.

(30) Foreign Application Priority Data

Oct. 21, 1996 (DE) ..... 196 43 281

(51) Int. Cl.[7] ..... C11D 3/37
(52) U.S. Cl. ..... 510/475
(58) Field of Search ..... 510/475

(56) References Cited

U.S. PATENT DOCUMENTS

| | | | | |
|---|---|---|---|---|
| 3,549,546 | | 12/1970 | Moore | 252/152 |
| 3,917,817 | * | 11/1975 | Vanlerberghe et al. | 424/70 |
| 4,013,787 | * | 3/1977 | Vanlerberghe et al. | 424/70 |
| 4,094,796 | | 6/1978 | Schwarz | 252/8.8 |
| 4,704,132 | | 11/1987 | Fikentscher et al. . | |
| 4,761,249 | | 8/1988 | Giede et al. . | |
| 5,128,053 | | 7/1992 | Gummo et al. | 252/8.6 |

FOREIGN PATENT DOCUMENTS

| | | | |
|---|---|---|---|
| 22 32 353 B2 | | 1/1973 | (DE) . |
| 28 14 287 A1 | | 1/1979 | (DE) . |
| 35 45 990 A1 | | 6/1987 | (DE) . |
| 0 209 787 | | 1/1987 | (EP) . |
| 0 462 806 B1 | | 1/1997 | (EP) . |
| WO 95/30792 | * | 11/1995 | (WO) . |

* cited by examiner

*Primary Examiner*—John Hardee
(74) *Attorney, Agent, or Firm*—Oblon, Spivak, McClelland, Maier & Neustadt, P.C.

(57) ABSTRACT

Polycationic condensates obtainable by condensing (a) piperazine, 1-alkylpiperazines having 1 to 25 carbon atoms in the alkyl group, 1,4-dialkylpiperazines having 1 to 25 carbon atoms in the alkyl group, l,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$–$C_{25}$-alkylimidazoles or mixtures of said compounds with (b) alkylene dihalides, epihalohydrins and/or bisepoxides in the molar ratio from 1:0.8 to 1:1.1 and, where appropriate, quaternization of the condensates with $C_4$–$C_{25}$-alkylating agents or by heating triethanolamine or triisopropanolamine in the presence of acidic catalysts and quaternizing the condensates with $C_4$–$C_{25}$-alkylating agents as color-fixing additive to detergents and fabric conditioners, and detergents which comprise (i) 1–50% by weight of at least one nonionic surfactant, (ii) 0–4.0% by weight of an anionic surfactant and (iii) 0.05–2.5% by weight of the polycationic condensate are used as color transfer inhibiting and color release reducing additive, and fabric conditioners which comprise a fabric softener, a nonionic surfactant and 0.1–2.5% by weight of said polycationic condensates.

9 Claims, No Drawings

POLYCATIONIC CONDENSATES AS COLOR TRANSFER INHIBITING AND COLOR RELEASE REDUCING ADDITIVE TO DETERGENTS AND FABRIC CONDITIONERS

This application is a Division of application Ser. No. 09/284,479 filed on Apr. 21, 1999; now U.S. Pat. No. 6,025,322, which was originally filed as International Application PCT/EP97/05606, on Oct. 10, 1997.

BACKGROUND OF THE INVENTION

1. Field of the Invention

The invention relates to the use of polycationic condensates as color transfer inhibiting and color release reducing additive to detergents and fabric conditioners, and to detergents and fabric conditioners which comprise polycationic condensates.

2. Description of the Background

When colored textiles are washed, the dye is partly released from the colored textiles and transferred from the wash liquor to other fabrics. If, for example, white laundry is washed together with colored textiles, the white laundry becomes soiled. In order to prevent transfer of the released textile dye from the wash liquor to the laundry, color detergents which contain polymeric color transfer inhibitors have been developed. The latter comprise, for example, homo- and copolymers of vinylpyrrolidone and vinylimidazole, cf. DE-B-22 32 353 and DE-A-28 14 287.

EP-A-0 462 806 discloses the use of cationic dye fixatives in after-wash treatment baths together with fabric softeners. The after-treatment of the laundry takes place in usual domestic washing machines at temperatures below 40° C. The dye fixatives can, according to the statements in the application, also be employed in nonionic detergents. The cationic fixatives slow down the release of the dye from the colored textiles during the treatment process.

SUMMARY OF THE INVENTION

It is an object of the present invention to provide more effective compositions for suppressing release and transfer of dyes to other textiles during the washing and during the after-treatment of colored textiles.

We have found that this objective is achieved by the use of polycationic condensates obtainable by condensing (a) piperazine, 1-alkylpiperazines having 1 to 25 carbon atoms in the alkyl group, 1,4-dialkylpiperazines having 1 to 25 carbon atoms in the alkyl group, 1,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$–$C_{25}$—C-alkylimidazoles or mixtures of said compounds with (b) alkylene dihalides, epihalohydrins and/or bisepoxides in the molar ratio from 1:0.8 to 1:1.1 and, where appropriate, quaternization of the condensates with $C_4$–$C_{25}$-alkylating agents or by heating triethanolamine or triisopropanolamine in the presence of acidic catalysts and quaternizing the condensates with $C_4$–$C_{25}$-alkylating agents as color transfer inhibiting and color release reducing additive to detergents and fabric conditioners.

DETAILED DESCRIPTION OF THE PREFERRED EMBODIMENTS

The condensates preferably used for this purpose are obtainable by condensing (a) piperazine, 1-(2-hydroxyethyl)piperazine, 1-(2-aminoethyl)piperazine, imidazole, $C_1$–$C_3$-C-alkylimidazoles or mixtures of said compounds with (b) 1,2-dichloroethane, 1,2-dichloropropane, 1,3-dichloropropane, 1,4-dichlorobutane, epichlorohydrin, bisepoxybutane or mixtures of said compounds and, where appropriate, (c) quaternizing the condensates with $C_6$–$_{22}$-alkyl halides or $C_8$–$C_{22}$-epoxides or by heating triethanolamine or triisopropanolamine with acidic catalysts and quaternizing the condensates with $C_6$–$C_{22}$-alkyl halides or $C_8$–$C_{22}$-epoxides.

The molecular weight of the condensates is, for example, from 500 to 100 000, preferably 1 000 to 50 000. Particularly preferred cationic condensates have molecular weights in the range from 1500 to 25 000.

The degree of guaternization of the amino groups in the condensates is, for example, at least 25%, preferably at least 50%. The best results are obtained with cationic condensates in which the degree of quaternization of the amino groups is from 70 to 100%. The condensates described above are disclosed in EP-B 0 209 787 and EP-A-0 223 064 as after-treatment agents for improving the wet fastness of colorings and printings with reactive dyes. The polycationic condensates particularly preferably employed for the applications according to the invention are those obtainable by reacting (a) piperazine and/or imidazole with (b) epihalohydrin or by-heating triethanolamine or triisopropanolamine in presence of acidic catalysts and subsequently reacting with $C_4$–$C_{22}$-alkyl halides, in particular $C_6$–$C_{12}$-alkyl halides such as, in particular, benzyl chloride.

The polycationic condensates are soluble in water or easily dispersible therein. They are preferably prepared by reacting the components in aqueous medium or without diluent. If the condensation is carried out in aqueous solution, the concentration of nonaqueous constituents is, for example, from 10 to 80, preferably 20 to 60, % by weight.

The polycationic condensates described above are used according to the invention either as additive to detergents or as additive to fabric conditioners. The cationic condensates prevent or suppress release of dyes from colored textiles during the washing process or during the after-treatment. The condensates to be used according to the invention have a maximum effect at concentrations of as little as from 10 to 100 ppm in the wash or rinse liquor, for example in the absence of anionic surfactants. There is virtually no increase in the efficacy if the amount used is increased further. By contrast, on use of dye fixatives disclosed in EP-A-0 462 806, the concentrations required to reach the effect which can be achieved with the condensates according to the invention are about 500 ppm.

The invention additionally relates to detergents which comprise (i) 1–50% by weight of at least one nonionic surfactant, (ii) 0–4.0% by weight, preferably to 2.5%, of an anionic surfactant and (iii) 0.05–2.5% by weight of at least one polycationic condensate which is obtainable by condensing (a) piperazine, 1-alkylpiperazines having 1 to 25 carbon atoms in the alkyl group, 1,4-dialkylpiperazines having 1 to 25 carbon atoms in the alkyl group, 1,4-bis(3-aminopropyl)piperazine, 1-(2-aminoethyl)piperazine, 1-(2-hydroxyalkyl)piperazines having 2 to 25 carbon atoms in the alkyl group, imidazole, $C_1$–$C_{25}$-alkylimidazoles or mixtures of said compounds with (b) alkylene dihalides, epihalohydrins and/or bisepoxides in the molar ratio from 1:0.8 to 1:1.1 and, where appropriate, quaternization of the condensates with $C_4$–$C_{25}$-alkylating agents or by heating triethanolamine or triisopropanolamine in the presence of acidic catalysts and quaternizing the condensates with $C_4$–$C_{25}$-alkylating agents.

Examples of suitable nonionic surfactants are alkoxylated $C_8$–$C_{22}$-alcohols. The alkoxylation can be carried out with ethylene oxide, propylene oxide and/or butylene oxide. The surfactants which can be employed in this case are all alkoxylated alcohols which contain at least two molecules of an abovementioned alkylene oxide in the adduct. Said alkylene oxide adducts can be block copolymers of ethylene oxide, propylene oxide and/or butylene oxide or adducts which contain said alkylene oxides in random distribution. The nonionic surfactants contain, for example, from 2 to 50, preferably 3 to 20, mol of at least one alkylene oxide per mole of alcohol in the adduct. Ethylene oxide is preferably employed as alkylene oxide. The alcohols are preferably derived from compounds having 10 to 18 carbon atoms. These may be natural or synthetic alcohols.

Another class of nonionic surfactants comprises alkyl polyglucosides having 8 to 22, preferably 10 to 18, carbon atoms in the alkyl chain. These compounds contain, for example, from 1 to 20, preferably 1.1 to 5, glucoside units.

Another class of nonionic surfactants comprises N-alkylglucamides of the general structure I or II

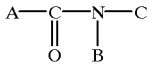

(I)

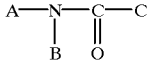

(II)

where A is $C_6$–$C_{22}$-alkyl, B is H or $C_1$–$C_4$-alkyl and C is a polyhydroxyalkyl radical having 5 to 12 carbon atoms and at least 3 hydroxyl groups. A is preferably $C_{10}$–$C_{18}$-alkyl, B is preferably $CH_3$ and C is preferably a $C_5$ or $C_6$ radical. Compounds of this type are obtained, for example, by acylating reductively aminated sugars with $C_{10}$–$C_{18}$-carbonyl chlorides. The detergent formulations preferably contain $C_{10}$–$C_{18}$-alcohols, ethoxylated with 3–12 mol of ethylene oxide, particularly preferably ethoxylated fatty alcohols, as nonionic surfactants.

Further suitable and preferred surfactants are the endgroup-capped fatty amide alkoxylates disclosed in WO-A-95/11225, of the formula $$R^1—CO—NH—(CH_2)_n—O—(AO)_x—R^2 \quad \text{(III)},$$

where

| | |
|---|---|
| $R^1$ | is $C_5$–$C_{21}$-alkyl or -alkenyl, |
| $R^2$ | is $C_1$–$C_4$-alkyl, |
| A | is $C_2$–$C_4$-alkylene, |
| n | is 2 or 3, and |
| x | is 1 to 6. |

Examples of such compounds are the products of the reaction of n-butyltriglycolamine of the formula $H_2N—(CH_2—CH_2—O)_3—C_4H_9$ with methyl dodecanoate or the products of the reaction of ethyltetraglycolamine of the formula $H_2N—(CH_2—CH_2—O)_4—C_2H_5$ with a commercial mixture of saturated $C_8$–$C_{18}$-fatty acid methyl esters.

The powder or granular detergents may additionally contain one or more builders. Examples of suitable inorganic builder substances are all conventional inorganic builders such as aluminosilicates, silicates, carbonates and phosphates.

Examples of suitable inorganic builders are aluminosilicates with iron-exchanging properties such as zeolites. Various types of zeolites are suitable, especially zeolites A, X, B, P, MAP and HS in their Na form or in forms, in which Na is partly replaced by other cations such as Li, K, Ca, Mg or ammonium. Suitable zeolites are described, for example, in EP-A-0 038 591, EP-A-0 021 491, EP-A-0 087 035, U.S. Pat. No. 4,604,224, GB-A-2 013 259, EP-A-0 522 726, EP-A-0 384 070 and WO-A-94/24251.

Examples of other suitable inorganic builders are amorphous or crystalline silicates such as amorphous disilicates, crystalline disilicates such as the sheet silicate SKS-6 (manufactured by Hoechst AG). The silicates can be employed in the form of their alkali metal, alkaline earth metal or ammonium salts. Na, Li and Mg silicates are preferably employed.

Further suitable inorganic builders substances are carbonates and bicarbonates. These can be employed in the form of their alkali metal, alkaline earth metal or ammonium salts. Preferably employed are Na, Li and Mg carbonates and bicarbonates, especially sodium carbonate and/or sodium bicarbonate.

The inorganic builders can be present in the detergents in amounts of from 0 to 60% by weight, together with organic cobuilders to be used where appropriate. The inorganic builders can be incorporated either alone or in any combination with one another into the detergent.

Powder or granular or other solid detergent formulations contain organic cobuilders in amounts of from 0 to 20% by weight, preferably in amounts of from 1 to 15% by weight, together with inorganic builders. The powder or granular heavy duty detergents may additionally contain other conventional ingredients such as bleach systems consisting of at least one bleach, where appropriate combined with a bleach activator and/or a bleach catalyst, and other conventional ingredients such as soil release polymers, antiredeposition agents, enzymes, inorganic fillers such as sodium sulfate, complexing agents, optical brighteners, dyes, perfume oils, foam suppressants, corrosion inhibitors, phosphates and/or phosphonates in the usual amounts.

The detergents are preferably free of anionic surfactants but may contain them as component (ii) in amounts of up to 4% by weight, preferably up to 2.5% by weight. Examples of suitable anionic surfactants are fatty alcohol sulfates of fatty alcohols having 8 to 22 carbon atoms, sulfated, ethoxylated $C_8$–$C_{22}$-alcohols and their water-soluble alkali metal and ammonium salts. Other suitable anionic surfactants are alkylsulfonates such as $C_8$–$C_{24}$-alkanesulfonates, and soaps such as the alkali metal salts of $C_8$–$C_{24}$-carboxylic acids. Also suitable as anionic surfactants are linear $C_9$–$C_{20}$-alkylbenzenesulfonates (LAS). The anionic surfactants may also be incorporated, for example, in the form of the hydroxyethylammonium, di(hydroxyethyl)ammonium and tri(hydroxyethyl)ammonium salts. If the detergents according to the invention contain anionic surfactants, those preferably employed are soaps, acylsarcosinates or sulfated ethoxylated $C_8$–$C_{22}$-alcohols.

The detergents contain according to the invention as component (iii) 0.05–2.5, preferably 0.1–1.0, % by weight of at least one of the cationic condensates described above.

The invention furthermore relates to fabric conditioners which comprise (i) 1–50% by weight of a fabric softener, (ii) 1–50% by weight of a nonionic surfactant and (iii) 0.1–2.5% by weight of a polycationic condensate which is obtainable by condensing (a) piperazine, 1-alkylpiperazines having 1 to 25 carbon atoms in the alkyl group, 1,4-dialkylpiperazines having 1 to carbon atoms in the alkyl group, 1,4-bis(3-aminopropyl)piperazine, 1-(2-aminoethyl)piperazine, 1-(2-hydroxyalkyl)piperazines having 2 to 25 carbon atoms in the alkyl group or by heating triethanolamine or triisopropanolamine in the presence of acid catalysts and quaternizing the condensates with $C_4$–$C_{25}$-alkylating agents, imidazole, $C_1$–$C_{25}$-alkylimidazoles or mixtures of said compounds with (b) alkylene dihalides, epihalohydrins and/or bisepoxides in the molar ratio from 1:0.8 to 1:1.1 and, where appropriate, quaternization of the condensates with $C_4$–$C_{25}$-alkylating agents or by heating triethanolamine or triisopropanolamine in the presence of acidic catalysts and quaternizing the condensates with $C_4$–$C_{25}$-alkylating agents.

The fabric conditioners contain as component (i) 1–50, preferably 2.5–30, % by weight of a fabric softener. Examples of suitable fabric softeners are quaternary ammonium compounds, polysiloxanes and nonionic cellulose ethers, cf., for example, EP-A-0 239 910, EP-A-0 150 867 and EP-A-0 213 730. Examples of fabric softeners are dialkyldimethylammonium chloride and alkylimidazolium methyl sulfates.

The fabric conditioners contain as component (ii) for example 1–50, preferably 2–20, % by weight of a nonionic surfactant. Nonionic surfactants have been described in connection with component (i) in the detergents. The compounds mentioned there can also be employed in fabric conditioners. The fabric conditioners contain as component (iii) 0.1–2.5, preferably 0.2–2.0, % by weight of a polycationic condensate as color-fixing additive. These condensates have been described above.

The percentages in the examples mean % by weight.

EXAMPLES

The following cationic condensates were used:

Polymer 1

Polycationic condensate prepared by condensing piperazine with epichlorohydrin in the molar ratio 1:1 and by quaternizing the reaction product with 1.4 mole equivalents of benzyl chloride based on piperazine. The molecular weight was 3500 (determined by measurement of the viscosity in a 1% strength aqueous solution at 20° C.). The cationic condensate was in the form of a 24% strength aqueous solution.

Polymer 2

Polycationic condensate prepared by reacting imidazole, piperazine and epichlorohydrin in the molar ratio 1:1:2. The aqueous polymer solution contained 50% of the cationic condensate, which had a molecular weight of 2200.

Polymer 3

Polycationic condensate prepared by reacting imidazole and epichlorohydrin in the molar ratio 1:1 in aqueous solution. The polymer solution contained 50% of the condensate, which had a molecular weight of 1400.

Polymer 4

Polycationic condensate prepared by heating triethanolamine in the presence of 0.5% by weight of hypophosphorous acid at 230° C. and quaternizing with 0.8 mole equivalent of benzyl chloride. The molecular weight was 4500.

In order to test the color release reducing and color transfer inhibiting effect of the cationic condensates described above, the abovementioned polymers were added to a commercial fabric softener. The colored fabric was prerinsed with an aqueous solution of the fabric softener at 25° C., rinsed again with tap water, dried and ironed. The colored fabrics treated in this way were then washed together with white test fabrics using a commercial detergent. The color strength of the white test fabrics was determined, comparing with the previously measured color strength, by the method of A. Kud, Seifen, Öle, Fette, Wachse, 119 (1993) 590–594. The color strengths of each of the stains on the white fabric were determined and, from this, the color transfer inhibiting effect of polymers 1 to 4 was determined.

To check the color loss of the colored test fabric, the treatment with fabric softener, subsequent washing and drying was repeated five times with the same colored fabric. The color loss was determined from the color strength of the colored fabric before the first wash and the color strength after the fifth wash by the following formula.

$$\text{Color loss [\%]} = 100 \cdot \frac{\text{color strength}_{(\text{before washing})} - \text{color strength}_{(\text{after washing})}}{\text{color strength}_{(\text{before washing})}}$$

| | |
|---|---|
| Test conditions: | |
| Machine: | Launder-o-meter |
| Colored fabric: | 1.0 g of colored cotton fabric, dyed with direct red 212 (3% dye) and direct blue 71 (0.8% dye) |
| White fabric: | 2.5 g of cotton fabric |
| Pretreatment: | |
| Fabric softener: | Softlan ® (manufactured by Colgate Palmolive)<br>Concentration of polymers employed in the fabric softener: 2.0%<br>Amount of fabric softener employed: 1.75 g/l<br>Temperature (rinsing): 30° C.<br>Rinsing time: 10 min. |
| Washing: | |
| Detergent: | Ajax ® (manufactured by Colgate-Palmolive) |
| Amount: | 5.0 g/l |
| Amount of liquor: | 250 g |
| Washing temperature: | 40° C. |
| Water hardness: | 14.5° German hardness |
| Ca/Mg ratio: | 4.0:1.0 |
| Washing time: | 30 min. |

Example 1

Polymer 1 was added to the abovementioned fabric softener in an amount of 2%. The %, color transfer inhibiting effect was 99% from a fabric dyed with direct blue 71. The % color loss from fabric dyed with direct blue 71 was 7.2% after 5 washes with the abovementioned detergent.

Comparative Example 1

Example 1 was repeated but in the absence of polymer 1. The color transfer inhibiting effect was 0%. The color loss after 5 washes for a fabric dyed with direct blue 71 was 20.3%.

Example 2

Example 1 was repeated with 2% polymer 4. The color transfer inhibiting effect was 98%, and the color loss was 8.4%.

TABLE 1

Tests with direct red 212

| Example | Polycationic condensate Type | Amount [%] in Softlan ® | Color transfer inhibition [%] | Color loss [%] |
|---|---|---|---|---|
| 3 | Polymer 1 | 2 | 100 | 11.3 |
| 4 | Polymer 2 | 2 | 95.1 | 18.9 |
| 5 | Polymer 3 | 2 | 93.8 | 15.4 |
| Comp. Ex. 2 | — | | 0 | 30.3 |

The following examples illustrate the effect of polymers 1 to 4 in various detergent compositions. The test conditions chosen for this were as follows:

| | |
|---|---|
| Machine: | Launder-o-meter |
| Colored fabric: | 1.0 g of colored cotton fabric, dyed with Direct red 212 (dyeing with 3% dye) and Direct blue 71 (dyeing with 0.8% dye) |
| White fabric: | 2.5 g of cotton fabric |
| Detergent composition in % (detergent A): | |
| $C_{13}/C_{15}$ oxo alcohol ethoxylate with 10 EO | 6.3 |
| Zeolite A | 55.0 |
| Na carbonate | 6.0 |
| Na citrate | 9.0 |
| Copolymer of 70% acrylic acid and 30% maleic acid, molecular weight 70,000, Na salt | 4.0 |
| Carboxymethylcellulose | 0.5 |
| Sodium sulfate | 5.8 |
| Water | to 100 |
| Washing: | |
| Detergent: | Detergent A |
| Amount: | 5.0 g/l |
| Amount of liquor: | 250 g |
| Washing temperature: | 60° C. |
| Water hardness: | 14.5° German hardness |
| Ca/Mg ratio: | 4.0:1.0 |
| Washing time: | 30 min. |

TABLE 2

| Example | Polycationic condensate | Amount [%] | Color transfer inhibition [%] | Color loss [%] |
|---|---|---|---|---|
| 6 | 1 | 0.5 | 97 | 8 |
| 7 | 1 | 1.0 | 99 | 5 |
| 8 | 4 | 1.0 | 98 | 7 |
| Comp. Ex. 3 | — | — | | 29 |

The color transfer inhibiting effect was determined after 1 wash, and the color release was determined after 5 washes, in each test from the color strength of the white fabric and of the colored fabric as described for the use in the fabric softener.

The results with polymers 1 and 4 to be used according to the invention show that the polymers have a very good color transfer inhibiting effect in detergents free of anionic surfactants. In addition, the color release from the colored fabrics is distinctly diminished, which drastically diminishes the fading of colored textiles on washing.

To check the efficacy of the cationic condensates to be used according to the invention in various detergent formulations, the color transfer inhibiting effect in various heavy duty detergents and color detergents was tested (Tables 3 and 4). In the exemplary formulations, the polycationic condensates show a distinct reduction in the color transfer and a reduction in the color release.

TABLE 3

| | I | II | III | IV | V | VI | VII |
|---|---|---|---|---|---|---|---|
| Polymer 1 | 1.5 | | 1.0 | 0.5 | | 0.6 | 0.3 |
| Polymer 2 | | 1.0 | | | | | |
| Polymer 3 | | | | | 1.0 | | |
| AA/MA (70000) | 7.5 | 6.0 | 5.0 | | 5.0 | | 4.0 |
| AA/MA/VAc terpolymer (40000) | | | | | | 5.0 | |
| Na perborate monohydrate | 15 | 15 | | | 15 | | 7.5 |
| Na percarbonate | | | 18 | 15 | | 18 | |
| TAED | 4.0 | 3.8 | 5.0 | 5.0 | 2.9 | 4.2 | 2.0 |
| Na lauryl sulfate | | | | 1.0 | | | |
| Linear alkylbenzene-sulfonate Na salt | | | 0.8 | | | | |
| Sulfated fatty alcohol ethoxylate | | | | | 1.5 | | |
| Korantin ® SH | 3.1 | | | | | 2.0 | |
| Soap | | | 0.4 | 2.5 | 1.5 | | 2.4 |
| $C_{13}/C_{15}$ oxo alcohol*3 EO | | 3.0 | | | | | |
| $C_{13}/C_{15}$ oxo alcohol*7 EO | 7.5 | | 4.7 | 16.5 | 8.0 | 6.5 | |
| $C_{13}/C_{15}$ oxo alcohol*10 EO | | 3.0 | | | | | |
| $C_{12}/C_{14}$ -fatty alcohol*7 EO | | | | | | | 10.0 |
| Lauryl alcohol*13 EO | | | | | | 5.0 | |
| Zeolite A | 25 | 25 | 15 | | 30 | 15 | 35 |
| Zeolite P | | | | 40 | | | |
| SKS-6 | | | 14 | | | 15 | |
| Na disilicate | 2.5 | 3.9 | | 0.5 | 4.5 | | 1.5 |
| Mq silicate | 1.0 | | 0.8 | | 1.0 | 1.0 | 0.6 |
| Sodium sulfate | 2.0 | 2.5 | 15.2 | 2.0 | 1.5 | 5.5 | 3.4 |
| Sodium bicarbonate | | | 9.0 | 6.5 | | | |
| Sodium carbonate | 12.0 | 13.6 | | | 10.0 | 8.0 | 9.8 |
| Sokalan ® HP 22 | | 0.4 | | | 0.5 | | |
| Polyethylene terephthalate/oxyethylene terephthalate | 1.0 | | | | 0.5 | 0.8 | 1.0 |
| Carboxymethyl-cellulose | 0.6 | 1.3 | 0.6 | 1.0 | 0.6 | 0.6 | 0.5 |
| Dequest ® 2046 (phosphonate) | | | | 0.5 | | | |
| Citric acid | | 6.8 | 5.0 | | | 2.5 | 3.8 |
| Lipase | | | | | 1.0 | | |
| Protease | | 1.0 | | | 1.0 | 0.5 | 0.6 |
| Cellulase | | | | | | | 0.6 |
| Water | to 100 | to 100 | to 100 | to 100 | to 100 | to 100 | to 100 |

Abbreviations

| | |
|---|---|
| TAED | Tetraacetylethylenediamine |
| SKS-6 | Sheet silicate Na salt (manufactured by Hoechst) |
| EO | Ethylene oxide |

-continued

| | |
|---|---|
| AA/MA (70000) | = acrylic acid/maleic acid copolymer in the ratio 70:30 by weight, molecular weight $M_w$ = 70,000 |
| AA/MA/VAc (40000) | = acrylic acid/maleic acid/vinyl acetate terpolymer in the molar ratio 40:10:50 with molecular weight $M_w$ = 40,000 |
| Sokalan ® HP 22 | commercial graft copolymer of vinyl acetate on polyethylene glycol (soil-release polymer) |
| Korantin ® SH | commercial oleylsarcosinate (acid form) |

Table 4 indicates the composition of color detergents containing cationic condensates to be used according to the invention.

TABLE 4

| | VII | VIII | IX | X | XI | XII |
|---|---|---|---|---|---|---|
| Polymer 1 | 1.0 | 1.0 | 0.5 | 1.0 | 0.5 | 0.3 |
| AA/MA (70000) | 6.0 | 4.0 | 3.5 | 2.0 | 2.5 | 8.5 |
| Na lauryl sulfate | | | 12 | | | |
| Sulfated fatty alcohol ethoxylate | | | | 1.5 | | |
| Korantin ® SH | | | | | 2.0 | |
| Soap | 2.5 | | 1.0 | 1.5 | 1.5 | |
| $C_{13}/C_{15}$ oxo alcohol*3 EO | | 10.0 | | | 1.5 | |
| $C_{13}/C_{15}$ oxo alcohol*7 EO | 6.7 | | 16.0 | 13.5 | 14.0 | 7.5 |
| $C_{13}/C_{15}$ oxo alcohol*10 EO | | 6.3 | | | | |
| Lauryl alcohol*13 EO | | | | 2.0 | | 9.0 |
| Zeolite A | 28 | 55 | 35 | | 37 | 18 |
| Zeolite P | | | | 36 | | |
| SKS-6 | | | 12 | | | |
| Na disilicate | 4.5 | | | 0.5 | 4.5 | |
| Mg silicate | | | 1.0 | | | 1.0 |
| Sodium sulfate | 24 | 5.8 | 11.5 | 8.0 | 4.5 | 10.0 |
| Sodium bicarbonate | | | 6.5 | 6.5 | | |
| Sodium carbonate | 12.0 | 6.0 | | | 10.0 | 9.0 |
| Carboxymethylcellulose | 0.6 | 0.5 | 0.6 | 1.0 | 0.6 | 0.6 |
| Sokalan ® HP 22 | 1.0 | | | | | 0.5 |
| Polyethylene terephthalate/ oxyethylene terephthalate | | | 1.0 | 0.5 | | 0.5 |
| Sodium citrate | 2.0 | 9.0 | | | | 2.5 |
| Protease | 0.5 | | | | | 1.0 |
| Cellulase | 1.0 | | 1.0 | | 0.8 | 1.0 |
| Water | to 100 | to 100 | to 100 | to 100 | to 100 | to 100 |

For abbreviations, see key to Table 3

We claim:

1. A detergent which comprises:

(i) 1–50% by weight of at least one nonionic surfactant, (ii) 0–4.0% by weight of an anionic surfactant and (iii) 0.05–2.5% by weight of at least one polycationic condensate obtained by condensing:

(a) compounds selected from the group consisting of imidazole, $C_1$–$C_{25}$-C-alkylimidazoles and mixtures thereof, with (b) compounds selected from the group consisting of alkylene dihalides, epihalohydrins, bisepoxides, and mixtures thereof in a molar ratio of from 1:0.8 to 1:1.1 and, optionally quaternizing said condensates with a $C_4$–$C_{25}$-alkylating agent;

or by heating triethanolamine or triisopropanolamine in the presence of an acidic catalyst and quaternizing said triethanolamine or triisopropanolamine condensate with one or more $C_4$–$C_{25}$-alkylating agents.

2. The detergent of claim 1, wherein the condensates have a molecular weight of from 500 to 100,000.

3. The detergent of claim 1, wherein the condensates have a molecular weight of from 1,000 to 500,000.

4. The detergent of claim 1, wherein the degree of quaternization of the amino groups in the condensates is at least 25%.

5. The detergent of claim 1, wherein the degree of quaternization of the amino groups in the condensates is at least 50%.

6. The detergent of claim 1, wherein the degree of quaternization of the amino groups in the condensates is from 70 to 100%.

7. The detergent of claim 1, which further includes at least one organic and/or inorganic builder.

8. The detergent of claim 1, which contains an anionic detergent in an amount up to 2.5% by weight.

9. The detergent of claim 1, which also contains at least one additive selected from bleaches, soil release polymers, anti-redeposition agents, enzymes, inorganic fillers, complexing agents, optical brighteners, dyes, perfumes, foam suppressants, corrosion inhibitors, bleach activators, bleach catalysts, phosphates or phosphonates.

* * * * *